US006651720B1

(12) United States Patent
DiSilvestro et al.

(10) Patent No.: US 6,651,720 B1
(45) Date of Patent: Nov. 25, 2003

(54) DUAL PANEL WINDOW SHADE APPARATUS

(76) Inventors: Earnest DiSilvestro, 1426 SpyGlass Ct., Itasca, IL (US) 60143; Robert D. Gaskill, 507 Falmore La., Bolingbrook, IL (US) 60440

( * ) Notice: Subject to any disclaimer, the term of this patent is extended or adjusted under 35 U.S.C. 154(b) by 0 days.

(21) Appl. No.: 09/543,216

(22) Filed: Apr. 5, 2000

(51) Int. Cl.[7] ..... E06B 9/08
(52) U.S. Cl. ..... 160/121.1
(58) Field of Search ..... 160/121.1, 122, 160/120, 241, 84.05, 237, DIG. 7, DIG. 11

(56) References Cited

U.S. PATENT DOCUMENTS 2,280,358 A * 4/1942 Teitig ..... 160/121.1
2,281,022 A * 4/1942 Cavanaugh ..... 160/121.1
2,970,643 A * 2/1961 Adamsky ..... 160/121.1
3,701,376 A * 10/1972 Froget ..... 160/121.1
4,344,474 A * 8/1982 Berman ..... 160/121.1
4,453,584 A * 6/1984 Steele ..... 160/121.1
5,419,385 A * 5/1995 Vogel et al. ..... 160/121.1
5,664,613 A * 9/1997 Jelic ..... 160/121.1 X
6,189,592 B1 * 2/2001 Domel ..... 160/241

* cited by examiner

*Primary Examiner*—David M. Purol
(74) *Attorney, Agent, or Firm*—Sonnenschein, Nath & Rosenthal

(57) ABSTRACT

A dual panel roller window shade apparatus includes an outer panel, an inner panel, a canopy, and a cord. The panels are radially spaced and rigidly attached to the spool at respective circumferential points. In operation, the spool is selectively operable via the cord such that the panels move generally vertically up and down relative to each other. A plurality of corresponding positive and negative designs may be formed on the panels.

25 Claims, 5 Drawing Sheets

DUAL PANEL WINDOW SHADE APPARATUS

FIELD OF THE INVENTION

The present invention relates generally to window treatment apparatus, and more particularly to a shifting dual panel window shade.

BACKGROUND OF THE INVENTION

Window treatments are well known. In addition to aesthetic features, window treatments also provide privacy, protection from sunlight, and thermal insulation. U.S. Pat. No. 58,688 discloses a double panel curtain window treatment, where a pair of panels 38, when extended, are spaced apart by a distance equal to the diameter of the roller 36, and wherein the two panels extend from the two different sides of the roller 36. The panels 38 are connected together along bottom portions thereof by tacking to a bottom bar v. Each of the panels 38 includes a series of aligned holes X. When the roller 36 is rotated a small amount, the alignment of the holes X changes, affecting the passage of light and air through the panels 38. One disadvantage of the '688 patent is that dust and debris tends to accumulate within the relatively large space or opening formed between the two panels.

U.S. Pat. No. 2,280,358 discloses a pair of window shade panels 10, 14 disposed either on a single roller or on a pair of rollers, whereby a small movement of one panel relative to the other panel will act to exclude light wholly or partially. In one embodiment, the panels comprise polarized elements which block light when the panels are in register with each other. As the polarized portions are moved further apart from registration, the amount of light that passes through the panels changes. In another embodiment, alternate opaque and transparent strips or sheets are employed. An elastic strip 15 is provided on either one or both of the sheets so that the panel having the elastic strip can be moved relative to the other panel without rotating the rollers.

Prior art window treatments are relatively complicated in construction and operation, and have the additional disadvantages discussed above. A need exists for a simple, easy to manufacture dual panel window shade having the advantages of the present invention.

The objects and the advantages of the present invention include providing a dual panel window shade apparatus that offers an unlimited choice of prints and patterns that can be incorporated into the sheer panels. The disclosed apparatus provides selective privacy from all angles inside the home and out, and the panels can include large or small prints or patterns. The present apparatus can be manufactured with an enclosed canopy in a small scale headrail, and can be mounted with no light gap between the window frame and the panels. The present apparatus can be produced in room darkening models, and since the panels are not cellular, the designs will not collect debris. Also, the disclosed invention can be manufactured simply, with few moving parts.

Other objects and advantages of the present invention will be apparent from the following detailed description of the illustrated embodiment of the invention.

SUMMARY OF THE INVENTION

The present invention is directed to a dual panel window shade apparatus. The apparatus includes an outer panel, an inner panel, a cord, a canopy and a spool. The panels can be made, for example, from fabric, paper, vinyl or the like. The spool is mounted within the canopy for rotation relative thereto. The panels are radially spaced apart and rigidly attached at respective upper ends thereof to an outer surface of the spool.

In operation, the respective panels extend over a rigid contact and guide surface, such as an edge of the canopy, for example, and hang generally downward therefrom. The spool is selectively rotatable via the cord and a clutch mechanism to move the panels generally up and down relative to one another. For example, as one panel moves up, the other panel moves down, and vice versa. Changing the diameter of the spool effects the offset shift of the two panels.

In one embodiment, one of the panels has a positive of a design, and the other of the panels has a negative and, in the illustrated embodiment, slightly larger print of a similar or identical design thereon. For example, the outer panel may have opaque portions of the design on a surface thereof, with sheer or scrim portions between the opaque design wherein light can pass through the sheer or scrim portions. The inner panel correspondingly includes sheer or scrim portions in alignment with the opaque design on the outer panel, and opaque designs in alignment with the sheer or scrim designs on the outer panel. In operation, as the spool is rotated, the corresponding sheer and opaque design portions become offset with respect to one another, varying the amount of light which passes through the apparatus.

DETAILED DESCRIPTION OF THE INVENTION

Figure 1:
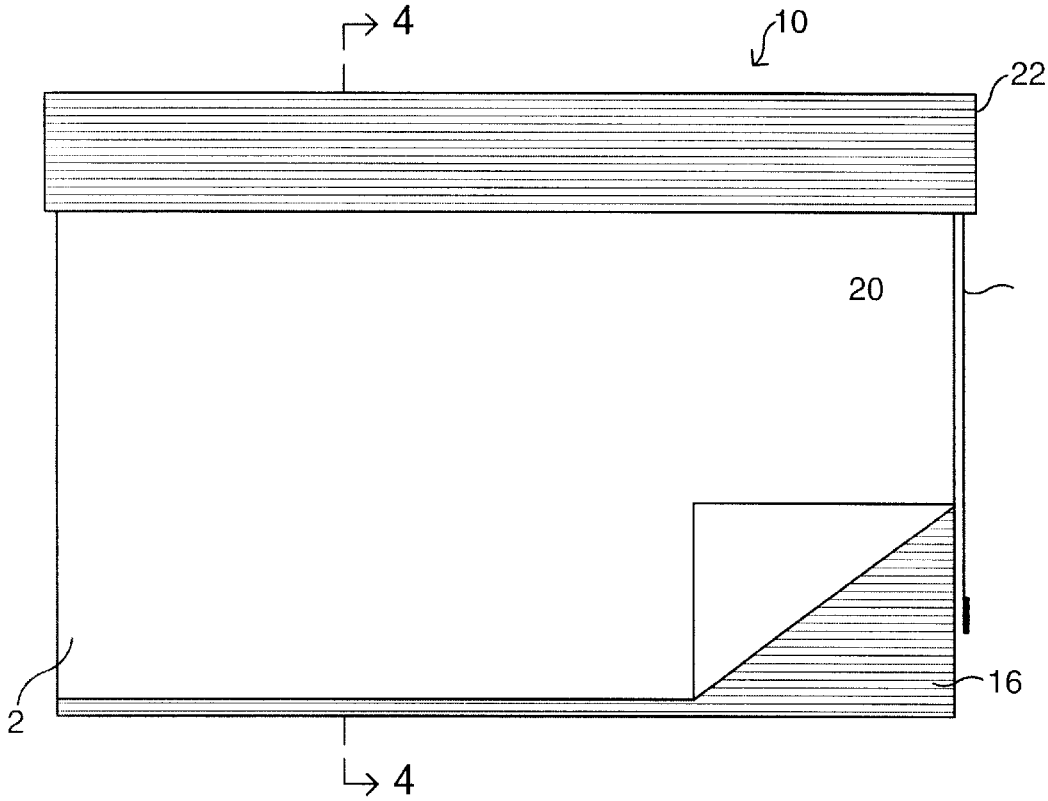
FIG. 1 is a front elevational view of a dual panel window shade apparatus embodying the present invention.
Figure 1A:
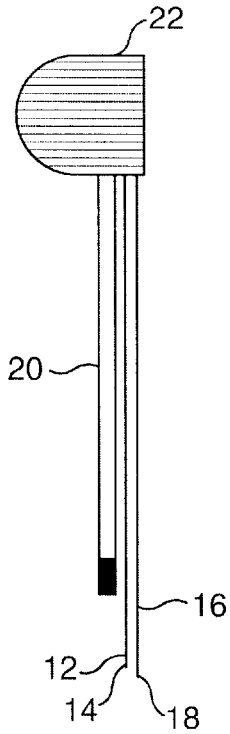
FIG. 1*a* is a side elevational view of the apparatus of FIG. 1.
Figure 4A:
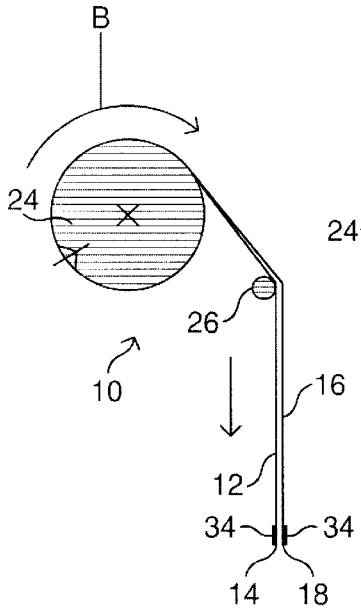
FIG. 4*a* is a sectional view of the apparatus taken along line X—X of FIG. 1 and showing the panels in a partially retracted configuration.
Figure 4B:
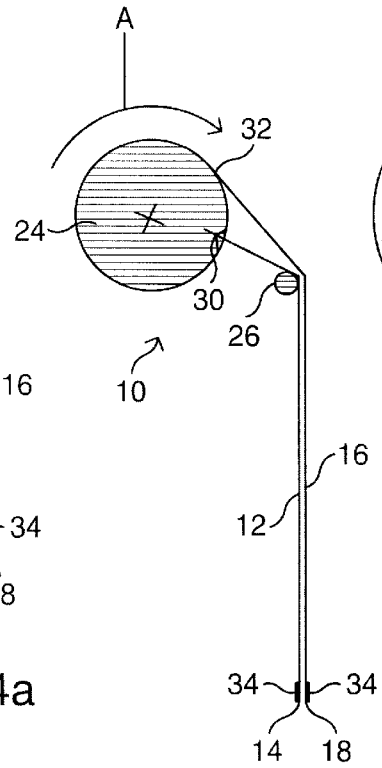
FIG. 4*b* is a sectional view of the apparatus taken along line X—X of FIG. 1 and showing both of the panels in fully extended positions.
Figure 4C:
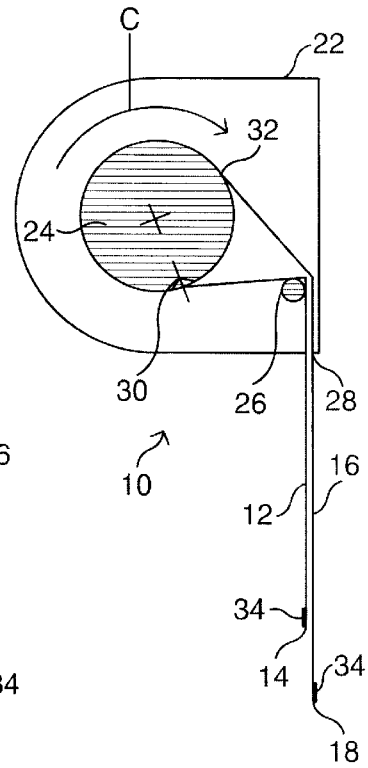
FIG. 4*c* is a sectional view of the apparatus taken along line X—X of FIG. 1 and showing one of the panels in an offset configuration with respect to the other panel.
Figure 5:
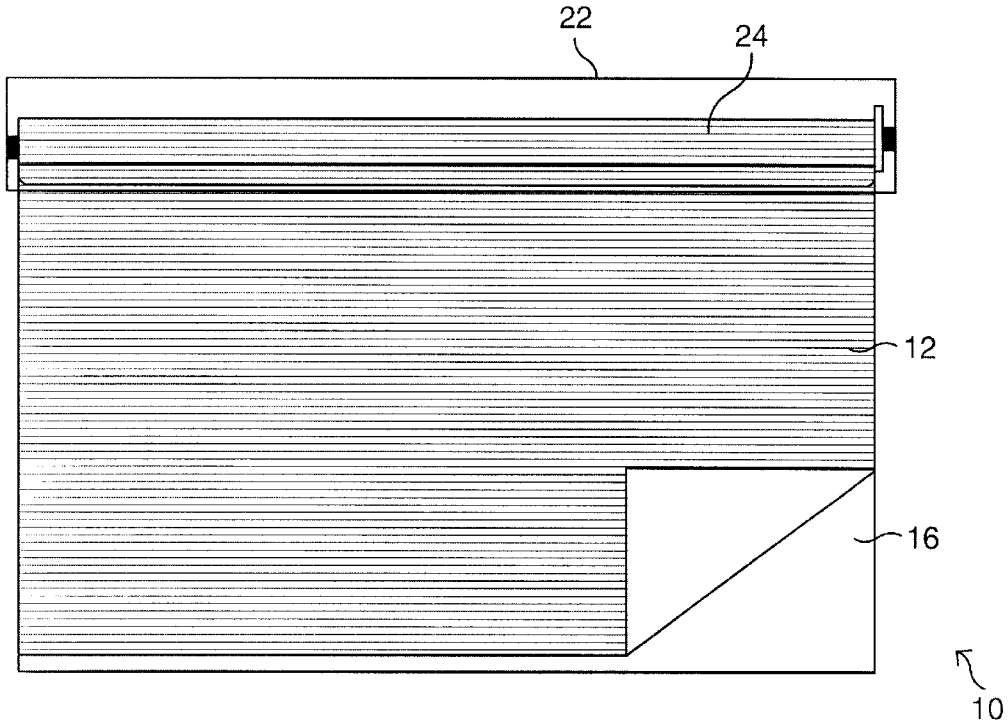
FIG. 5 is a front elevational view of the apparatus of FIG. 1 showing a cutaway view of the spool thereof.
Figure 5A:
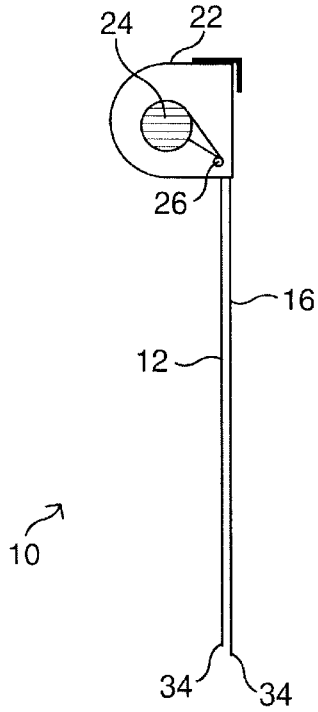
FIG. 5*a* is a side elevational view of the apparatus of FIG. 5.

Referring to the drawings and FIGS. 1, 4 and 5 in greater detail, the reference number 10 refers to a dual panel window shade apparatus embodying the present invention. The apparatus 10 includes an outer panel 12 having a bottom 14, an inner panel 16 having a bottom 18, a cord 20, a canopy 22, and a spool 24.

FIG. 1 and FIG. 4*b* show the outer panel 12 and the inner panel 16, each in a respective fully extended position. In this configuration, the distance from any point on the canopy 22 to each of the bottoms 14, 18 is the same. As discussed more below, the cord 20 is used in connection with a clutch mechanism (not shown) to rotate the spool 24 for vertical movement of the panels 12, 16.

Referring to FIG. 4*c*, the spool P is mounted within the canopy 22 for rotation, indicated for example by arrow A, relative to the canopy 22. A low friction surface or guide roller 26 is rigidly attached to the canopy to guide the exit of the panels 12, 16 from the canopy 22 through an opening 28 formed in a lower portion of the canopy 22 or in the rear lower edge of canopy 22.

In one embodiment, the outer panel 12 is rigidly connected to spool 24 at circumferential point 30, and inner panel 16 is rigidly connected to the spool 24 at point 32 on the circumference thereof. In another embodiment, the panels 12, 16 can be made from a single piece of material, wherein the material is attached to the spool 24 at point 30, and the portion of fabric comprising panel 16 extends around the spool and out through the opening 28 from point 30.

As discussed more below (see FIGS. 4 and 5), in operation the panels 12, 16 move generally vertically up and down relative to each other in the range of up to several inches. For example, as the outer panel 12 moves down, the inner panel 16 moves up, and vice-versa, upon rotation of spool 24.

Referring now to FIG. 4, starting with the position whereby both of the panels 12, 16 are rolled up around the spool 24, the spool 24 is rotated in the direction shown by arrow B through well known methods comprising manipulation of two strands comprising the cord 20. The panels 12, 16 move in unison downwards over the adjacent window as a result of weights 34 affixed near the bottoms 14, 18 of each of the panels 12, 16. When the panels 12, 16 reach the position shown in FIG. 4, the panels 12, 16 are both in the fully extended position, and points 30 and 32 are in the position shown in FIG. 4*b*.

Referring to FIG. 4*c*, to shift the position of the panels 12, 16 relative to each other, the spool 24 is rotated from the position shown in FIG. 4*b* as shown by arrow 20, whereby attachment point 32 moves arcuately toward the spool 26, and attachment point 30 moves arcuately away from the spool 26. As shown in FIG. 4*c*, the outer panel 12 has thus moved vertically upward, while the inner panel 16 has moved vertically downward.

To raise the panels 12, 16, the spool 24 is rotated in a direction opposite to that shown by arrow 20, whereby the panels 12, 16 are first moved into a position co-extensive with each other, and then are both rewound upon the spool 24 and into the canopy 22.

Figure 2:
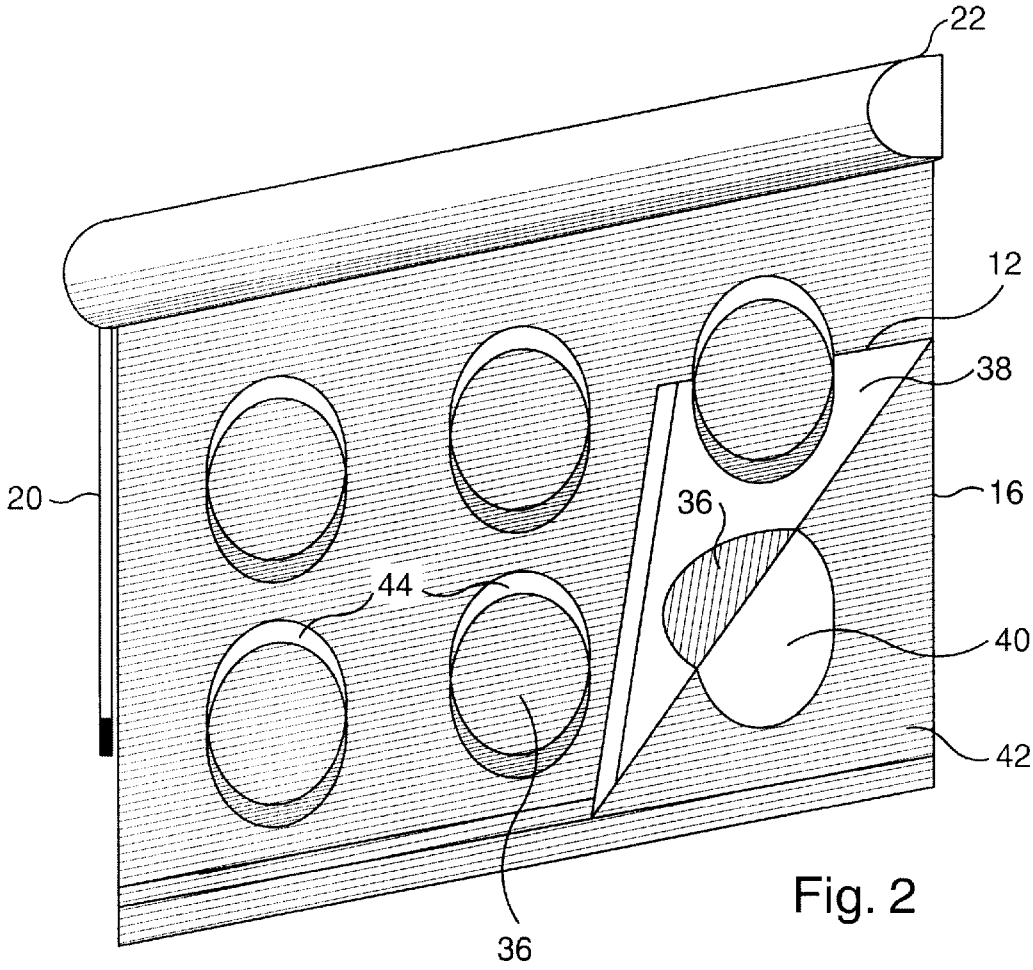
FIG. 2 is a perspective view of the apparatus shown in FIGS. 1 and 1*a*, wherein a design comprising six circles is incorporated on each of a pair of panels of the apparatus.
Figure 3:
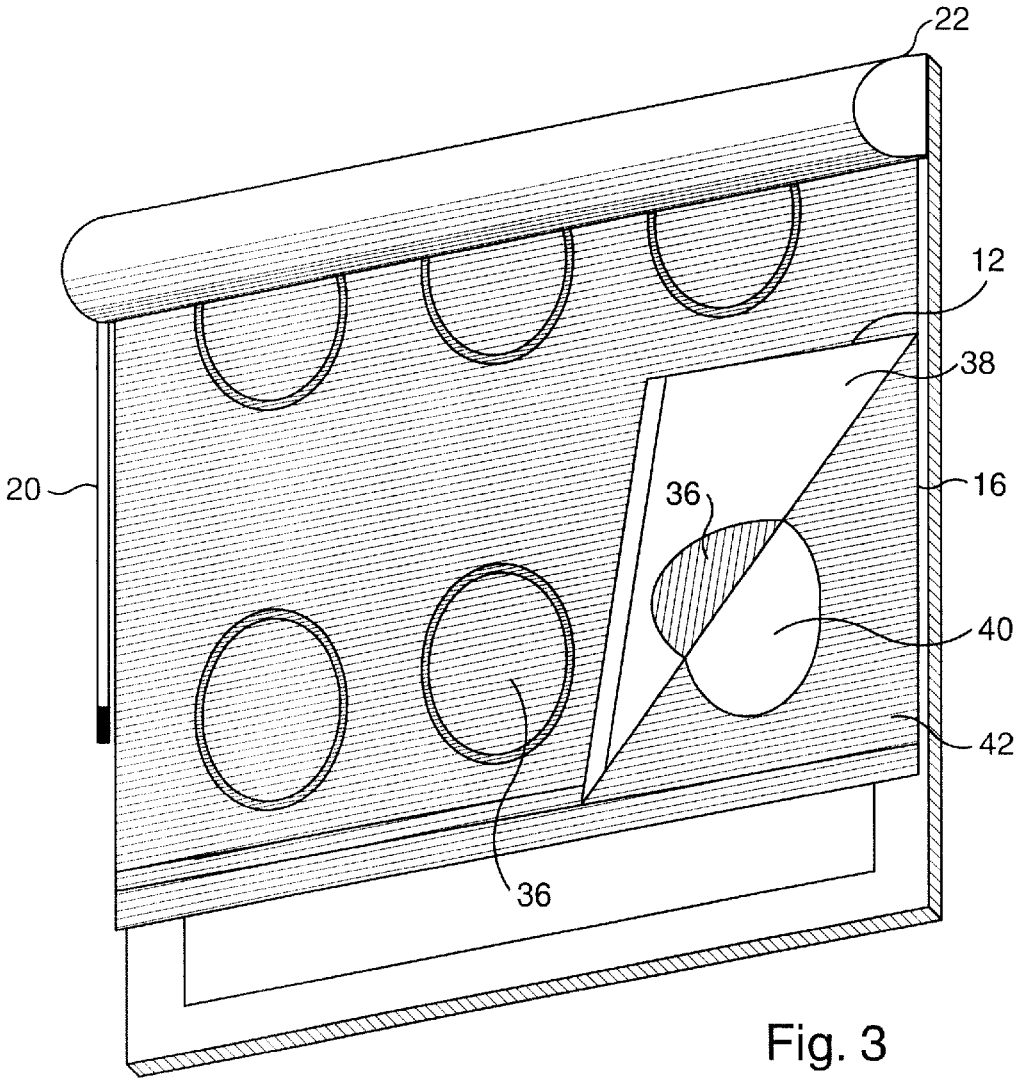
FIG. 3 is a perspective view of the apparatus of FIG. 2 and illustrates the relative position between the panels when portions of the designs completely block light from passing through either of the panels.

Referring to FIGS. 2 and 3, one of the panels 12, 16 has a positive design thereon, while the other panel comprises a negative of the same design. Referring to FIG. 2, for example, on the outer panel 12, a plurality of circles 36 are shown as opaque portions of a design, while the remaining portion 38 of the outer panel 12 comprises sheer or scrim material. Conversely, the inner panel 16 comprises a corresponding series of circles 40 of sheer or scrim material, while the remaining portion 42 of panel 16 is opaque. Thus, the outer panel 12 may have opaque portions of the design on the surface thereof, with sheer or scrim portions between the opaque design elements, wherein light can pass through the sheer or scrim portions. The inner panel 16 correspondingly includes sheer or scrim design portions in horizontal alignment with the opaque design on the outer panel, and opaque designs in horizontal alignment where the design on the outer panel 12 is sheer. Therefore, one of the panels contains a positive, and the other panel contains a negative of the same design. The opaque portions of one or the other panels is slightly oversized to provide total privacy when the panels are closed, as illustrated in FIG. 3.

In the position of the panels 12, 16 shown in FIG. 2, the outer panel 12 has been lowered with respect to the inner panel 16, as discussed above, wherein the opaque circles 36 move downward, allowing light to pass through the scrim portions 38, 40 of the panels 12, 16. Light transmitting areas are designated as 44' in FIG. 2. The amount of light entering the room and the view from the room can be adjusted by varying the position of the outer panel 12 with respect to the inner panel 16, which increases or decreases the corresponding areas 44'.

FIG. 3 illustrates the relative position between the panels 12, 16 wherein the opaque circles 36 are directly over the scrim portion 40 in the inner panel 16, thereby completely blocking light from passing through either of the panels 12, 16. In this position, the apparatus 1 is effectively shut, and no light passes through the panels 12, 16.

Further, as each panel 12, 16 includes the weight 34 rigidly attached at its bottom 14, B1, the panels 12, 16 tend to adhere to or hang close to one other, which tends to eliminate the accumulation of dust and debris between the panels 12, 16. The panels 12, 16 have also been designed to adhere at their side edges to a conventional window frame (not shown). This protects light from coming in the side of the shade, and reduces the horizontal spacing or light gap between the panels 12, 16 and the window frame.

As indicated above and as shown in FIG. 4*c*, the panels 12, 16 could comprise one continuous piece of fabric or material that extends completely around the spool 24, with attachment points at 32 or 30. A further embodiment would include only the attachment point 30, without the attachment point 32.

While the specification of the invention is described in relation to certain implementations or embodiments, many details are set forth for purposes of illustration. Thus, the foregoing merely illustrates the principles of the invention. For example, this invention may have other specific forms without departing from its spirit or essential characteristics. The described arrangements are illustrated and not restricted. To those skilled in the art the invention is susceptible to additional implementations or embodiments and certain of the details described in this specification can be varied considerably, without departing from the basic principles of the invention. It will thus be appreciated that those skilled in the art will be able to devise various arrangements that, although not explicitly described or shown here, embody the principles of the invention. They are thus within the spirit and scope of the invention.

What is claimed is:

1. A window shade apparatus, comprising:

(a) a spool having an outer surface; said spool rotatably mounted within a canopy; said canopy including a lower surface having an opening formed therein;

(b) a pair of panels comprising an outer panel and an inner panel; said panels rigidly attached to said spool outer surface in spaced apart relation;

(c) a guide surface attached to said canopy generally adjacent said opening for guiding said panels through said opening; said panels extending through said opening and generally downward therefrom; and (d) one of said panels moving generally vertically upward and the other of said panels moving generally vertically downward when said spool is rotated in one direction.

2. The window shade apparatus of claim 1, further comprising a first plurality of designs formed in said outer panel and a second plurality of designs formed in said inner panel.

3. The window shade apparatus of claim 2, wherein said panels are selectively moveable by rotating said spool from a first position wherein said first plurality of designs are generally in horizontal alignment with said second plurality of designs to a second position wherein said first plurality of designs is offset with said second plurality of designs.

4. The window shade apparatus of claim 3 wherein said first plurality of designs is made of a sheer material and said second plurality of designs is made of an opaque material.

5. The window shade apparatus of claim 4 wherein each of said second plurality of designs is larger than each of a corresponding one of said first plurality of designs to completely cover said first plurality of designs with a corresponding one of said second plurality of designs when said spool is rotated to said first position.

6. The window shade apparatus of claim 4 wherein the amount of light passing through said first and second panels varies as said spool is rotated from said first position to said second position.

7. The window shade apparatus of claim 3 wherein said first plurality of designs is made of an opaque material and said second plurality of designs is made of a sheer material.

8. The window shade apparatus of claim 7 wherein the amount of light passing through said first and second panels varies as said spool is rotated from said first position to said second position.

9. The window shade apparatus of claim 1 further comprising a first weight attached to a lower portion of said outer panel and a second weight attached to a lower portion of said inner panel.

10. The window shade apparatus of claim 1, further comprising a first plurality of designs and a second plurality of designs formed in each of the outer panel and the inner panel.

11. The window shade apparatus of claim 10, wherein the first plurality of designs in the outer panel is made of a shear material and the second plurality of designs in the outer panel is made of an opaque material while the first plurality of designs in the inner panel is made of an opaque material and the second plurality of designs in the inner panel is made of a sheer material.

12. The window shade apparatus of claim 10, wherein the first plurality of designs in the outer panel is made of an opaque material and the second plurality of designs in the outer panel is made of a sheer material while the first plurality of designs in the inner panel is made of a shear material and the second plurality of designs in the inner panel is made of an opaque material.

13. A window shade apparatus, comprising:

a spool having an outer surface, said spool rotatably mounted within a canopy, said canopy including a lower surface having an opening formed therein;

a pair of panels comprising an outer panel and an inner panel, said panels rigidly attached to said spool outer surface in spaced apart relation wherein one of said panels moves generally vertically upward and the other of said panels moves generally vertically downward when said spool is rotated in one direction;

a guide surface attached to said canopy generally adjacent said opening for guiding said panels through said opening, said panels extending through said opening and generally downward therefrom;

a first plurality of designs on said outer panel; and a second plurality of designs on said inner panel; said second plurality of designs comprising a negative of the first plurality of designs wherein said panels are selectively movable by rotating said spool from a first position wherein said first plurality of designs are generally in alignment with said second plurality of designs to a second position wherein said first plurality of designs is offset relative to said second plurality of designs.

14. The window shade apparatus of claim 13 wherein said first plurality of designs is made of a sheer material and said second plurality of designs is made from an opaque material.

15. The window shade apparatus of claim 13 wherein said first plurality of designs is made of an opaque material and said second plurality of designs is made from a sheer material.

16. The window shade apparatus of claim 14 wherein the amount of light passing thorough said first and second panels varies as said spool is rotated from said first position to said second position.

17. The window shade apparatus of claim 16 wherein each of said second plurality of designs is larger than each of a corresponding one of said first plurality of designs to completely cover said first plurality of designs with a corresponding one of said second plurality of design when said spool is rotated to said first position.

18. The window shade apparatus of claim 15 wherein the amount of light passing thorough said first and second panels varies as said spool is rotated from said first position to said second position.

19. The window shade apparatus of claim 13 further comprising a first weight attached to a lower portion of said outer panel and a second weight attached to a lower portion of said inner panel.

20. A window shade apparatus, comprising:

a cylindrical spool, said spool comprising a first end, a second end, and an outer surface, said spool rotatably mounted within a canopy at said ends of said spool, said canopy including a lower surface having an opening formed therein;

a pair of panels comprising an outer panel and an inner panel, said panels rigidly attached to said spool outer surface in spaced apart relation;

a guide surface attached to said canopy generally adjacent said opening for guiding said panels through said opening, said panels extending through said opening and generally downward therefrom;

a first plurality of designs on said outer panel; and a second plurality of designs on said inner panel, said second plurality of designs comprising a negative of the first plurality of designs wherein said panels are selectively movable by rotating said spool from a first position wherein said first plurality of designs are generally in horizontal alignment with said second plurality of designs to a second position wherein said first plurality of designs is offset with said second plurality of designs, each of said second plurality of designs is larger than each of a corresponding one of said first plurality of designs to completely cover said first plurality of designs with a corresponding one of said second plurality of designs when said spool is rotated to said first position.

21. The window shade apparatus of claim 20 wherein said first plurality of designs is made of a sheer material and said second plurality of designs is made from an opaque material.

22. The window shade apparatus of claim 20 wherein said first plurality of designs is made of an opaque material and said second plurality of designs is made of a sheer material.

23. The window shade apparatus of claim 21 wherein the amount of light passing thorough said first and second panels varies as said spool is rotated from said first position to said second position.

24. The window shade apparatus of claim 22 wherein the amount of light passing thorough said first and second panels varies as said spool is rotated from said first position to said second position.

25. The window shade apparatus of claim 20, further comprising a first weight attached to a lower portion of said outer panel and a second weight attached to a lower portion of said inner panel.

* * * * *